US005194025A

United States Patent [19]

Blanchard et al.

[11] Patent Number: 5,194,025

[45] Date of Patent: Mar. 16, 1993

[54] VIBRATION ABSORBING STEERING DEVICE FOR OUTBOARD MOTOR

[75] Inventors: Clarence E. Blanchard, Kenosha, Wis.; Edward K. Lam, Waukegan, Ill.

[73] Assignee: Outboard Marine Corporation, Waukegan, Ill.

[21] Appl. No.: 847,928

[22] Filed: Mar. 6, 1992

[51] Int. Cl.[5] ..... B63H 21/28

[52] U.S. Cl. ..... 440/52; 440/53; 440/900

[58] Field of Search ..... 440/51, 111, 900, 53; 248/634–643; 267/141.2; 74/480 B

[56] References Cited

U.S. PATENT DOCUMENTS

| | | | |
|---|---|---|---|
| 1,689,032 | 10/1928 | Johnson . | |
| 1,932,785 | 10/1933 | Irgens | 440/52 |
| 2,041,704 | 5/1936 | Gordon et al. . | |
| 2,549,486 | 4/1951 | Kiekhaefer . | |
| 2,585,774 | 2/1952 | Heidner et al. | 440/52 |
| 2,605,734 | 8/1952 | Watkins | 440/52 |
| 2,718,866 | 9/1955 | Kiekhaefer | 440/52 |
| 2,911,936 | 11/1959 | Kiekhaefer . | |
| 3,599,594 | 8/1971 | Taipale . | |
| 4,583,953 | 4/1986 | Nakase . | |
| 4,747,796 | 5/1988 | Iwai et al. | 440/52 |
| 5,055,074 | 10/1991 | Westberg et al. . | |

*Primary Examiner*—Joseph F. Peters, Jr.
*Assistant Examiner*—Stephen P. Avila
*Attorney, Agent, or Firm*—Welsh & Katz, Ltd.

[57] ABSTRACT

A vibration absorbing steering device for an outboard motor having a swivel bracket constructed and arranged for mounting to a transom bracket of a boat and defining a vertical passageway includes a tubular pivot shaft being pivotally engaged in the passageway, an engine mount bracket designed to mount the engine for rotation with the pivot shaft, and a vibration absorbing torque tube for absorbing vibration generated by the engine. The torque tube is vertically disposed within the tubular pivot shaft and is secured at one end to the pivot shaft. A tiller arm has a pivot end attached to the upper end of the torque tube so that the tiller arm is connected to the engine mount bracket through the torque tube, and the torque tube absorbs vibration from the engine which would normally be transmitted through the tiller arm to the operator. In addition to absorbing engine vibration, the present device also permits positive steering control of the motor by manipulation of the tiller arm.

20 Claims, 2 Drawing Sheets

VIBRATION ABSORBING STEERING DEVICE FOR OUTBOARD MOTOR

BACKGROUND OF THE INVENTION

The present invention relates to steering mechanisms for outboard motors, and specifically to a steering mechanism which is designed to minimize the transmission of engine vibrations through the tiller arm to the operator.

Conventional outboard motors provide a direct structural connection between the pivoting engine portion and the tiller arm in order to make the steering as responsive as possible. However, an undesirable side effect of this direct connection is that the tiller arm receives and transmits engine vibrations to the operator. The length of the tiller arm has the tendency to magnify this vibration, so that the free or gripped end of the tiller arm is prone to considerable shaking. This vibration is irritating and fatiguing to the operator, and makes boating less pleasant.

One prior attempt at minimizing the transmission of engine vibrations through to the tiller arm involves the insertion of rubber pads in the tiller arm which surround a horizontally oriented coupling pin secured between the engine motor mount bracket and the tiller arm. In another device, the tiller arm is mounted to the engine through a bracket including a vertically oriented pivot bolt, and is also provided with a coiled shock absorbing spring on either side of the bolt. Other attempts at reducing transmitted engine vibrations involve the use of resilient or rubberized pads, bushings, and/or engine mounts. The above-identified prior devices have not achieved optimum minimization of the transmission of engine vibrations.

Accordingly, it is an object of the present invention to provide a device for minimizing the transmission of outboard engine vibrations to the tiller arm.

It is another object of the present invention to provide a vibration absorbing mechanism for an outboard motor in which the vibrations are absorbed by the steering linkage without sacrificing precise steering control.

SUMMARY OF THE INVENTION

The present invention achieves the above-identified objects by providing a vibration absorbing steering device for an outboard motor in which the engine vibrations are absorbed by the steering linkage without sacrificing precise steering control. The tiller arm is isolated from the vibrations while maintaining direct control over the position of the engine.

More specifically, the present vibration absorbing steering device is for an outboard motor having a transom bracket for mounting to a boat, an engine, and swivel bracket constructed and arranged for mounting to the transom bracket and defining a vertical passageway. A tubular pivot shaft having an upper end and a lower end is dimensioned to be pivotally engaged in the passageway, and an engine mount device is designed to mount the engine for rotation about a vertical axis and relative to the swivel bracket. A tiller arm is also provided, and has a pivot end. The present device also includes a vibration absorbing component for absorbing vibrations generated by the engine, the component being vertically disposed in the tubular pivot shaft and positioned relative to the tiller arm and the engine mount device so that vibrations generated by the engine are transmitted through the engine mount device and absorbed by the vibration absorbing component. The absorbing component also is connected between the pivot end of the tiller arm and the engine mount device to permit positive steering control of the motor by manipulation of the tiller arm.

In the preferred embodiment, the vibration absorbing component preferably takes the form of a torque tube having upper, central and lower portions, each portion having a wall thickness, with the central portion having a relatively thinner wall thickness than the upper and lower portions to optimize vibration absorbing characteristics. The torque tube has an upper end and a lower end, the lower end secured to the lower end of the pivot shaft. The tiller arm has a pivot end attached to the upper end of the torque tube, so that the tiller arm is connected to the engine mount device through the torque tube and the torque tube absorbs vibration from the engine which would normally be transmitted through the tiller arm to the operator.

DESCRIPTION OF THE PREFERRED EMBODIMENT

Figure 2:
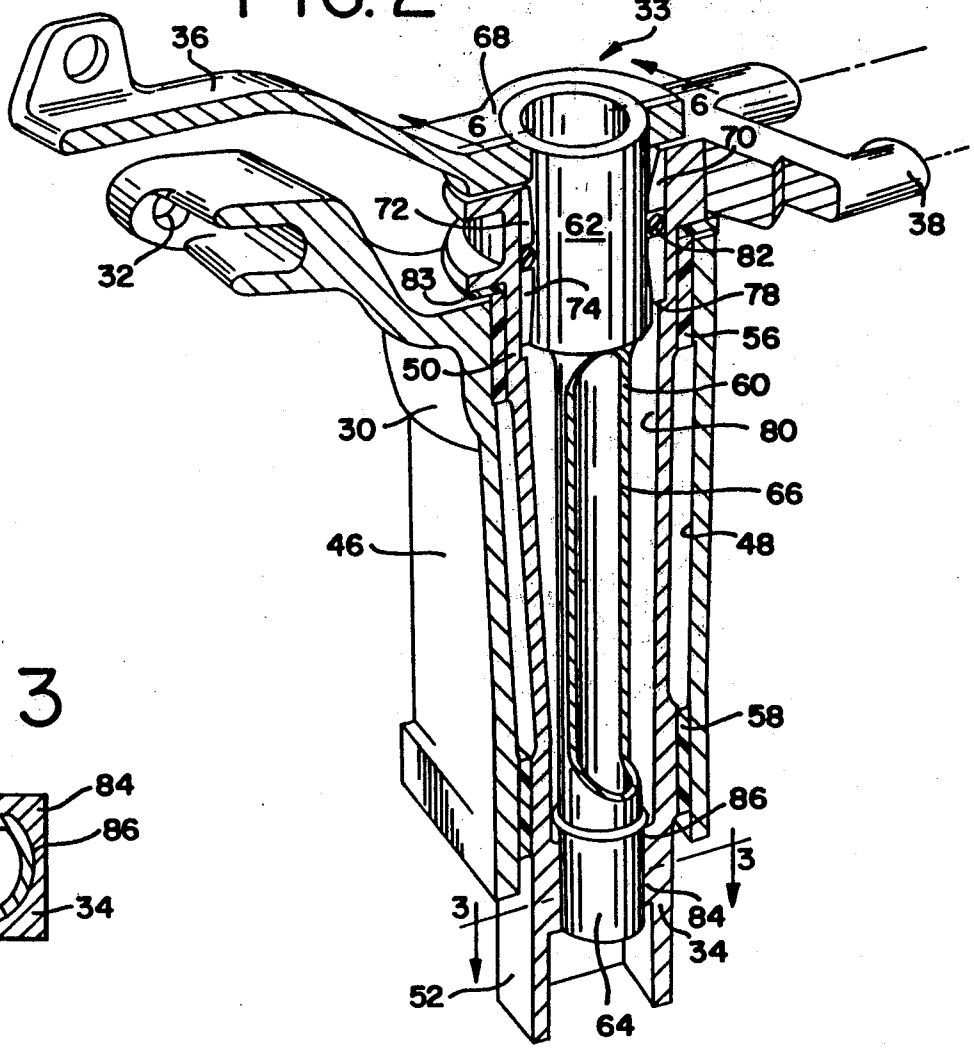
FIG. 2 is a top perspective view of the present vibration absorbing steering device.
Figure 1:
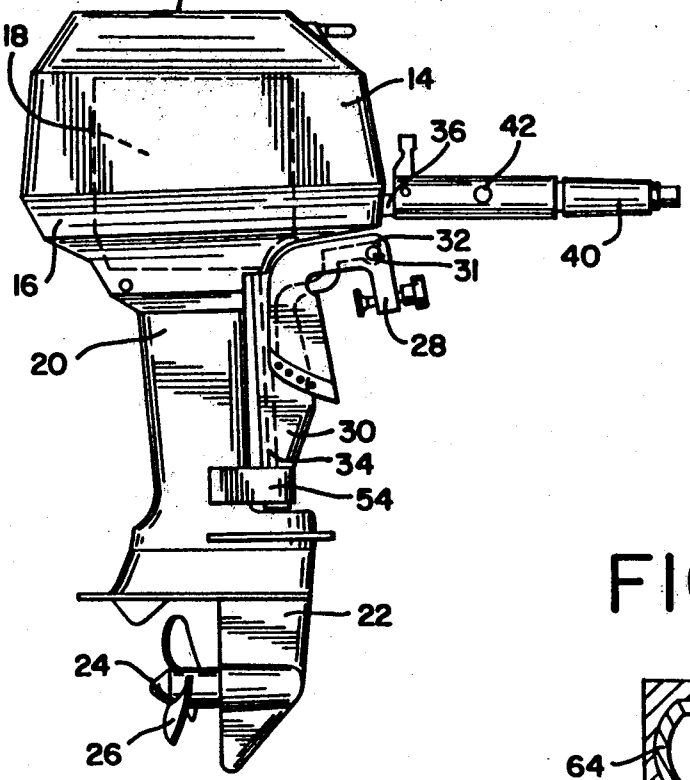
FIG. 1 is a side elevational view of an outboard motor of the type suitable for use with the present invention.

Referring to FIGS. 1 and 2, an outboard motor, designated generally at 10, is provided with an upper housing 12 including an upper motor cover 14 and a lower motor cover 16, which combine to enclose an engine 18 (shown hidden). Below the upper housing 12, an exhaust housing 20 has passageways (not shown) for accommodating the engine drive shaft, the engine exhaust, and the connection of the drive shaft to the transmission, the latter component being enclosed by the gearcase 22. A propeller shaft 24 equipped with a propeller 26 projects rearwardly from the gearcase 22.

The motor 10 has a transom bracket 28 for mounting the motor to the transom of a boat hull (not shown). A swivel bracket 30 is mounted to the transom bracket 28 by a horizontally disposed pivot pin 31. The pivot pin 31 passes through openings 32 (only one shown in FIG. 2) in the swivel bracket 30 and provides a pivot axis which permits the tilting of the lower end of the motor 10 out of the water when not in use.

The engine 18 is supported for pivotal steering movement on the swivel bracket 30, and relative to the boat, by a king pin assembly 33 which incorporates the vibration absorbing steering feature of the invention. The king pin assembly 33 includes a vertical pivot shaft 34 which is journalled within the swivel bracket 30. Also included in the king pin assembly 33 is a tiller arm 36 which is disposed relative to an upper end of the swivel bracket 30, and an engine mount bracket 38 to which the engine 18 is attached. The king pin assembly 33 is configured so that pivotal movement of the tiller arm 36 causes a similar pivotal displacement of engine 18, the exhaust housing 20, and the gearcase 22 relative to the swivel bracket 30 to steer the boat. If desired, the tiller arm 36 may be provided with engine controls, such as a rotatable grip portion 40 for throttle control, and a stop switch assembly 42. The swivel bracket 30 includes a substantially vertical tubular portion 46 defining a vertical passageway 48 which houses portions of the king pin assembly 33.

In conventional outboard engines, a direct connection between the engine and the tiller arm has been desirable for achieving optimum steering response, since a direct connection avoids the problem of excess play between the tiller arm and the engine. However, a drawback of such an arrangement is that vibrations generated by the operation of the engine are transmitted directly through the tiller arm to the operator. After long periods of operation, this vibration becomes annoying and fatiguing.

Figure 3:
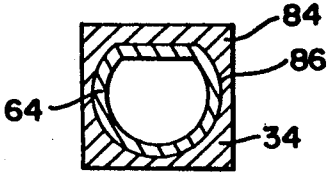
FIG. 3 is a sectional view taken along the line 3—3 of FIG. 2 and in the direction indicated generally.
Figure 6:
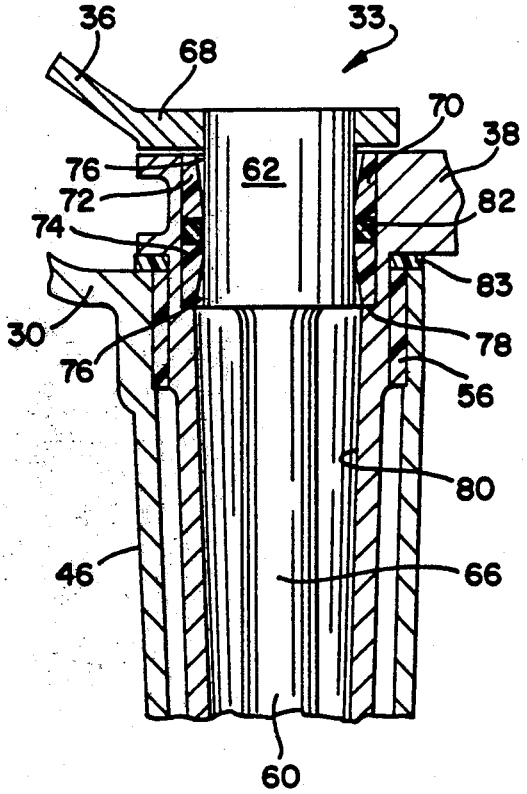
FIG. 6 is a fragmentary sectional view taken along the line 6—6 of FIG. 2 and in the direction indicated generally.

Referring now to FIGS. 2, 3 and 6, the present vibration absorbing steering feature of the king pin assembly 33 is provided at the junction of the swivel bracket 30, the tiller arm 36, and the engine mount bracket 38. Included in the assembly 33 is the pivot shaft 34, which is preferably tubular and has an upper end 50 and a lower end 52, and which is dimensioned to be pivotally engaged in the vertical passageway 48 of the swivel bracket 30. The lower end 52 of the pivot shaft 34 is supported and connected to the exhaust housing 20 by a bracket 54 (best seen in FIG. 1). It is preferred that the lower end 52 of the pivot shaft 34 is square or otherwise polygonal in cross-section to matingly engage a resilient bushing (not shown) which is rotatably engaged in the bracket 54.

The engine mount bracket 38 is preferably integrally joined to the upper end 50 of the pivot shaft 34 so that the engine 18, when fastened to the bracket 38, pivotally moves with the pivot shaft relative to the swivel bracket 30. It is also contemplated that the engine mount bracket 38 may be alternately secured to the pivot shaft 34 by welding, fasteners, or other conventional fastening arrangements. The position of the pivot shaft 34 relative to the passageway 48 is maintained by upper and lower annular bushings 56, 58, respectively. In the preferred embodiment, the bushings 56, 58 are made of low friction plastic, however it is contemplated that other durable, low friction materials may also be used.

Also included in the king pin assembly 33 is a torque tube 60 having an upper end 62, a lower end 64, and a central portion 66. The torque tube 60 is disposed between the tiller arm 36 and the engine 18 to absorb engine vibrations before they are transmitted to the tiller arm. More specifically, the torque tube 60 is vertically disposed in the tubular pivot shaft 34 so that one end of the torque tube is secured to the pivot shaft. In the preferred embodiment, the torque tube 60 is concentrically positioned within the pivot shaft 34 and the lower end 64 of the torque tube is secured to the lower end 52 of the pivot shaft.

It is preferable for optimum dampening and absorption of engine vibrations that the torque tube 60 be as long as possible. In the preferred embodiment, the torque tube 60 extends at least the entire length of the pivot shaft 34. The central portion 66 of the torque tube may be relatively thinner in cross-section or wall thickness and diameter relative to the upper end 62 in order to more efficiently absorb engine vibrations. The upper end 62 of the torque tube 60 is generally barrel-shaped and is preferably fastened to an eyelet-shaped pivot end 68 of the tiller arm 36 to complete the connection of the engine mount bracket 38 to the tiller arm. The torque tube 60 may be welded or otherwise suitably fastened to the tiller arm 36; however, these components may also be provided as an integral unit.

It is also contemplated that the engine mount bracket 38 may be connected in other ways through the king pin assembly 33 to the tiller arm 36. However, the basic goal of the arrangement of the pivot shaft 34, tiller arm 36, engine mount bracket 38 and torque tube 60 is that vibrations generated by the engine 18 and transmitted through the engine mount bracket 38 are transmitted to, and absorbed by, the torque tube 60 before being transmitted to the tiller arm 36.

In order to further absorb engine vibrations, the upper end 62 of the torque tube 60 is journalled within the upper end 50 of the tubular pivot shaft 34, and is circumscribed by a two-piece upper torque tube bushing 70. The bushing 70 acts as a cushion between the torque tube 60 and the pivot shaft 34 and maintains the torque tube in concentric disposition relative to the tubular pivot shaft 34. The bushing 70 is annular in shape and has an upper portion 72 and a lower portion 74, each with an inner surface 76. The respective inner surfaces of the upper and lower portions, 72, 74 are tapered so that an upper end of the upper portion, and a lower end of the lower portion are relatively thinner in cross-section or wall thickness than the respective opposite ends. The lower portion 74 rests on a shoulder 78 formed in the inner surface 80 of the pivot shaft 34.

An O-ring 82 is disposed between the upper and lower portions 72, 74 adjacent the ends having the relatively thicker cross-sections. The O-ring 82 rests on the d upper end of the lower portion 74, and the upper portion 72 is placed upon the O-ring. The bushing 70, and particularly the O-ring 82, functions to engage the torque tube 60 and absorb fore and aft vibrations generated by the motor 18 when operating at high r.p.m. A flat resilient bushing 83 facilitates rotation of the upper end 50 of the pivot shaft 34 relative to the swivel bracket 30.

Referring now to FIGS. 2 and 3, a preferred embodiment for attaching the lower end 64 of the torque tube 60 to the lower end 52 of the tubular pivot shaft 34 includes a keyed bracket 84 secured within the pivot shaft, and which defines a keyed or noncircular opening 86. In the embodiment of FIGS. 2 and 3, the opening 86 is generally D-shaped, although other noncircular shapes are contemplated. The lower end 64 of the torque tube 60 has a cross-sectional shape to matingly engage the opening 86 and to be nonrotatable therein. This nonrotatable relationship is desired for positive steering control. In the preferred embodiment, the cross-section of the lower end 64 is also D-shaped.

Figure 4:
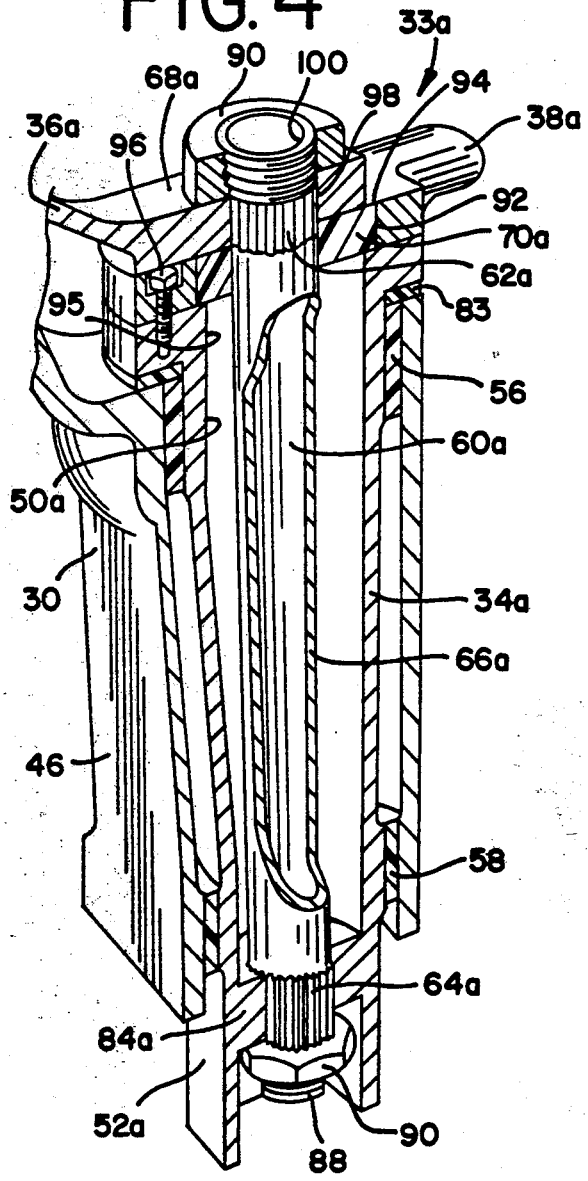
FIG. 4 is a top perspective view of an alternate embodiment of the present vibration absorbing steering device.

Referring now to FIG. 4, an alternate embodiment for the king pin assembly 33 is generally indicated at 33*a*. The components of assembly 33*a* which are identical to those of assembly 33 are designated with the same reference numerals. Components which have been modified are designated with the subscript "a". The major differences between the embodiments 33 and 33*a* lie in the attachment of the torque tubes 60, 60*a* to the tiller arm 36*a* and the pivot shaft 34*a*. In the assembly 33*a*, the torque tube 60*a* has an upper end 62*a* a lower end 64*a*, both of which are splined, and a central portion 66*a* having approximately the same diameter and cross-sectional thickness as the upper and lower ends.

The lower end 52*a* of the tubular pivot shaft 34*a* is provided with a bracket 84*a* which is splined to mate with the splines of the lower end 64*a* of the torque tube 60*a*. In this manner, the torque tube 60*a* is prevented from rotating relative to the pivot shaft 34*a*. If desired, the lower tip 88 of the torque tube 60*a* may be threaded to accommodate a locknut 90.

At the upper end 62*a* of the torque tube 60*a*, the two-piece upper torque tube bushing 70 is replaced with a one-piece annular rubber bushing 70*a* which maintains the position of the torque tube 60*a* relative to the pivot shaft 34*a*. The bushing 70*a* is seated in a bushing recess 92 defined by an annular portion 94 of the engine mounting bracket 38*a*. The recess 92 is of slightly larger diameter than the opening 95 in the upper end 50*a* of the pivot shaft 34.

While the engine mounting bracket 38 and the pivot shaft 34 are preferably made of one piece in the embodiment of FIG. 2, in the embodiment of FIG. 4, the mounting bracket 38*a* and the pivot shaft 34*a* are fastened together by at least one fastener 96, depicted as a bolt. In this manner, the pivot shaft 34*a* moves in unison with the engine mounting bracket 38*a*, as well as with the engine 18.

To provide secure attachment of the tiller arm 36*a* to the torque tube 60*a*, the pivot end 68*a* of the tiller arm is provided with a splined opening 98 which engages the splined upper end 62*a* of the torque tube. If desired, a locknut 90 may be secured to a threaded upper tip 100 of the torque tube 60*a* to more securely retain the tiller arm 36 thereupon.

Figure 5:
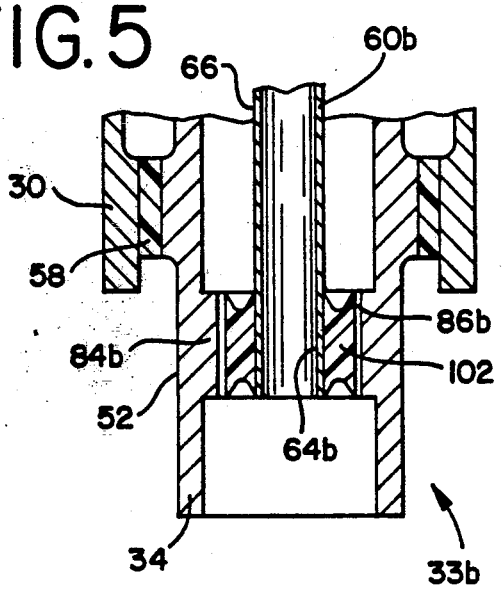
FIG. 5 is a fragmentary vertical sectional view of a second alternate embodiment of the present vibration absorbing steering device.

Referring to FIG. 5, another alternate embodiment is provided, in which components identical to those in previously described embodiments are designated with the same reference numerals, and modified components are followed by a "b" subscript. The assembly, generally designated 33*b*, relates specifically to the attachment of the torque tube 60*b* to the bracket 84*b* of the pivot shaft 34. The upper portion of the assembly 33*b* may be configured either as assembly 33 or 33*a*. The lower end 64*b* of the torque tube 60*b* has a cross-section and diameter equal to that of the central portion 66. The bracket 84*b* is not keyed, but preferably defines a cylindrical opening 86*b*.

In this embodiment, a spacer or bushing 102 made of rubber or resilient, durable plastic is vulcanized or otherwise bonded to the lower end 64*b* of the torque tube 60*b*. The bushing 102 and torque tube 60*b* are then wedged into position, with the bushing being compressed into the confines of the bracket 84*b*. An advantage of the use of the bushing 102 is that undue experimentation for determining the optimum vibration absorbing diameter of the torque tube 60*b* is unnecessary. Instead, the bushing 102 absorbs excess engine vibrations and prevents their transmission through to the tiller arm 36.

In operation, and regardless of the embodiment 33, 33*a* or 33*b*, once assembled into an outboard motor, engine vibrations are transmitted into the pivot shaft 34 and are absorbed by the torque tube 60. The torque tube 60 can be tailored in size, diameter, and cross-section to reduce or eliminate unwanted vibrations, depending on the size of the engine 18. Vibrations are transmitted down the pivot shaft 34 and then must travel up the torque tube 60 where they are absorbed before being transmitted to the tiller arm 36. In addition to absorbing engine vibrations, the torque tube 60 acts as a torsion spring which will preserve positive steering control by the operator upon manipulation of the tiller arm 36. Thus, the operator will not perceive excessive play in the steering mechanism.

While a particular embodiment of the vibration absorbing steering device for an outboard motor of the invention has been shown and described, it will be appreciated by those skilled in the art that changes and modifications may be made thereto without departing from the invention in its broader aspects and as set forth in the following claims.

What is claimed is:

1. A vibration absorbing steering device for an outboard motor having a transom bracket, an engine, and a swivel bracket constructed for mounting to the transom bracket and defining a vertical passageway, said device comprising:

a tubular pivot shaft having an upper end and a lower end and being dimensioned to be pivotally engaged in the passageway;

engine mount means for mounting the engine for rotation about a vertical axis and relative to said swivel bracket;

a tiller arm having a pivot end; and absorbing means for absorbing vibrations generated by the engine, said absorbing means including a torque tube having first and second ends, said first end of said torque tube being immovably fastened to said pivot shaft, and said second end being immovably fastened to said pivot end of said tiller arm, said torque tube being vertically disposed in said tubular pivot shaft and positioned relative to said tiller arm and said engine mount means so that vibrations generated by the engine are transmitted to said engine mount means and absorbed by said absorbing means prior to reaching said tiller arm, while providing positive steering control of the motor by manipulation of said tiller arm.

2. The device of claim 1 wherein said torque tube has an upper portion, a central portion, and a lower portion, each of said portions having a wall thickness, said central portion having a relatively thinner wall thickness than said upper and lower portions.

3. The device of claim 1 wherein said pivot shaft has an internally mounted support bracket defining an opening for accommodating a lower end of said absorbing means.

4. The device of claim 3 wherein said opening is splined and said lower end of said absorbing means is splined to matingly engage said opening.

5. The device of claim 3 wherein said absorbing means is a tubular member having a compressible elastomeric bushing disposed at said lower end of said absorbing means for frictional engagement in said opening.

6. The device of claim 3 wherein said lower end of said absorbing means is shaped to have a keyed relationship with said opening.

7. The device of claim 1 wherein said engine mount means is connected to said pivot shaft.

8. The device of claim 7 wherein said pivot end is connected to an upper end of said torque tube, said torque tube is connected at a lower end to said lower end of said pivot shaft, and said engine mount means is connected to said upper end of said pivot shaft.

9. The device of claim 1 further including an annular bushing disposed between said upper end of said absorbing means and said upper end of said pivot shaft.

10. The device of claim 9 wherein said bushing is provided with an inner surface having tapered upper and lower ends.

11. The device of claim 10 wherein said bushing includes upper and lower portions, each having a tapered end, and is provided with an O-ring disposed between said upper and lower portions for contact with said upper end of said absorbing means.

12. The device of claim 1 wherein said engine mount means is an engine mounting bracket.

13. A vibration absorbing steering device for an outboard motor having a transom bracket, an engine, and a swivel bracket constructed and arranged for mounting to the transom bracket and defining a vertical passageway, said device comprising:

a tubular pivot shaft having an upper end and a lower end and being dimensioned to be pivotally engaged in the passageway;

an engine mount bracket having a first end fastened to said upper end of said pivot shaft for rotation therewith;

a torque tube for absorbing vibrations generated by the engine being vertically disposed in said tubular pivot shaft, said torque tube having an upper end and a lower end, said lower end being immovably secured to said lower end of said pivot shaft; and a tiller arm having a pivot end immovably attached said upper end of said torque tube so that said tiller arm is connected to said engine mount bracket through said torque tube;

so that vibrations generated by the engine are transmitted to said engine mount bracket and absorbed by said torque tube prior to reaching said tiller arm, while providing positive steering control by said tiller arm of said pivot shaft.

14. The device of claim 13 wherein said torque tube has an upper portion, a central portion, and a lower portion, each of said portions having a wall thickness, said central portion having a relatively thinner wall thickness than said upper and lower portions.

15. The device of claim 13 wherein said pivot shaft has an internally mounted support bracket defining an opening for accommodating a lower end of said torque tube.

16. The device of claim 15 wherein said opening is splined and said lower end of said torque tube is splined to matingly engage said opening.

17. The device of claim 15 wherein said torque tube has a compressible elastomeric bushing disposed at said lower end of said torque tube for frictional engagement in said opening.

18. The device of claim 15 wherein said lower end of said torque tube is shaped to have a keyed relationship with said opening.

19. A vibration absorbing steering device for an outboard motor having a transom bracket, an engine, and a swivel bracket constructed for mounting to the transom bracket and defining a vertical passageway, said device comprising:

a tubular pivot shaft having a first end and a second end and being dimensioned to be pivotally engaged in the passageway;

engine mount means for mounting the engine for rotation about a vertical axis and relative to the swivel bracket;

a tiller arm having a pivot end; and absorbing means for absorbing vibrations generated by the engine, said absorbing means including a torque tube being vertically disposed in said tubular pivot shaft and having a first end and a second end, said first ends of said pivot shaft and said torque tube being in corresponding relationship to each other, said first end of said torque tube being immovably fastened to said first end of said pivot shaft;

one of said second end of said pivot shaft and said second end of torque tube being fixed to said engine mount means and the other being fixed to said tiller arm so that vibrations generated by the engine are transmitted to said engine mount means and absorbed by said absorbing means prior to reaching said tiller arm, while providing positive steering control of the motor by manipulation of said tiller arm.

20. The steering device of claim 19 wherein said second end of said pivot shaft is fixed to said engine mount means, and said second end of said torque tube is fixed to said tiller arm.

* * * * *